US006427508B1

(12) United States Patent
Lehto et al.

(10) Patent No.: US 6,427,508 B1
(45) Date of Patent: Aug. 6, 2002

(54) AUTOMATED COLLAR-FORMING DRILL MECHANISM

(75) Inventors: Pertti Lehto, Laihia; Kari Haavisto, Vaasa; Vesa Ropponen, Punkalaidun; Timo Saari, Laihia, all of (FI)

(73) Assignee: T-Drill Oy, Laihia (FI)

( * ) Notice: Subject to any disclaimer, the term of this patent is extended or adjusted under 35 U.S.C. 154(b) by 0 days.

(21) Appl. No.: 09/710,511

(22) Filed: Nov. 10, 2000

(30) Foreign Application Priority Data

Nov. 12, 1999 (FI) ..... 992437

(51) Int. Cl.[7] ..... B21D 31/02

(52) U.S. Cl. ..... 72/71; 72/325; 72/443; 72/453.02; 72/453.03

(58) Field of Search ..... 72/71, 325, 326, 72/330, 443, 453.02, 453.03, 453.06

(56) References Cited

U.S. PATENT DOCUMENTS 3,884,060 A * 5/1975 Larikka ..... 72/71
4,175,413 A * 11/1979 Van Geffen ..... 72/71
4,414,835 A * 11/1983 Larikka ..... 72/71
5,205,149 A * 4/1993 Hayashi ..... 72/453.06
5,209,094 A * 5/1993 Edmonds, Jr. et al. ..... 72/71

FOREIGN PATENT DOCUMENTS

FI 880521 11/1989 ..... B21C/37/29

* cited by examiner

*Primary Examiner*—Ed Tolan
(74) *Attorney, Agent, or Firm*—Klauber & Jackson

(57) ABSTRACT

An automated collar-forming drill mechanism, having the bottom end of its rotatable drive shaft (1) fitted with a tool head (2), which is driven axially back and forth by means of a piston-cylinder assembly (5–9), the drive shaft (1) extending through its piston rod (9). The axially directed operations of the tool head (2) are effected by means of a pneumatic part of the piston-cylinder assembly and a limitation to the speed of working operations is effected by means of a hydraulic part of the piston-cylinder assembly. The operating speeds upwards and downwards, as well as the reversing points for operating speeds and direction, are adjustable.

9 Claims, 3 Drawing Sheets

AUTOMATED COLLAR-FORMING DRILL MECHANISM

The invention relates to an automated collar-forming drill mechanism, comprising a rotatable drive shaft, a tool head mounted on the end of the drive shaft, an actuator for rotating the drive shaft, transfer means for carrying the drive shaft and the tool head back and forth in axial direction, said tool head comprising a drill for drilling a hole in the wall of a workpiece, such as a pipe, as the tool head is carried in one axial direction during a drilling operation, and collar-forming pegs adapted to extend below the hole rims and to extract the hole-encircling wall material for a collar as the tool head is carried in the opposite axial direction during a collar-forming operation.

This type of collar-forming drill devices are prior known e.g. from Patent publications U.S. Pat. Nos. 3,884,060 and 3,592,038. In these prior art mechanisms, the working actions are based on designing the drive shaft as a screw spindle and on maneuvering the struts seated against a pipe to be machined by means of a bifurcated nut element, which is engageable with a rotating spindle provided with a left-hand helix. This arrangement involves a number of drawbacks. Operating speeds and directions are dependent on the rotational speed and direction of the spindle. Thus, the motions or actions cannot be optimized. In addition, the nut and the screw spindle wear in use, which reduces the service life of the mechanism or results repeatedly in a labour-intensive and expensive maintenance action.

It is an object of the invention to provide an automated collar-forming drill mechanism improved in such a way that the operating speeds, operating ranges or distances, speed variation points, and reversing points of a tool head may all be selected as desired and provided with versatile regulating options, in addition to which the wear and maintenance demand are minimal for equipment responsible for power transmission.

This object is achieved on the basis of the characterizing features set forth in the appended claim 1. The dependent claims disclose preferred embodiments of the invention.

Figure 1:
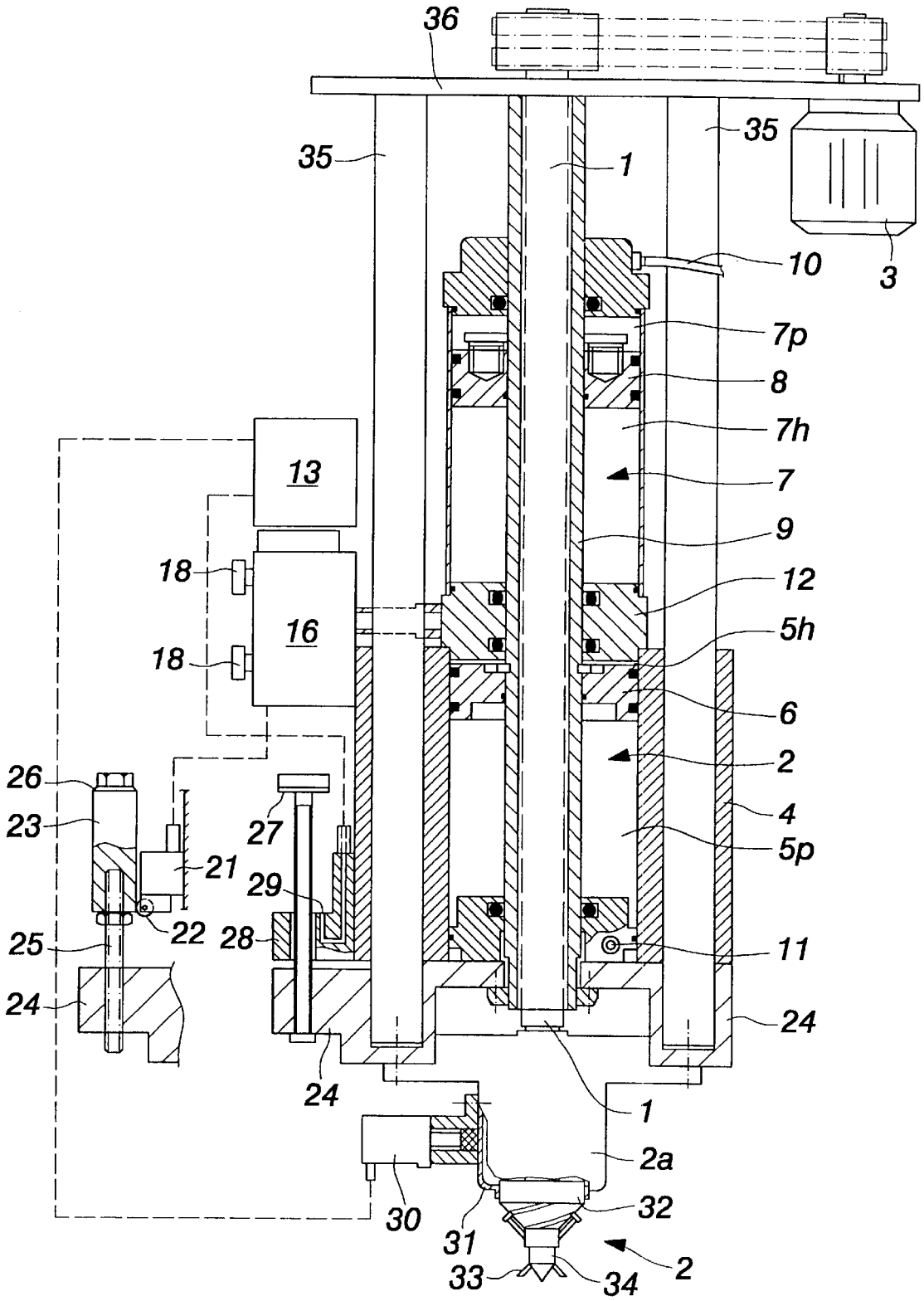
Figure 2:
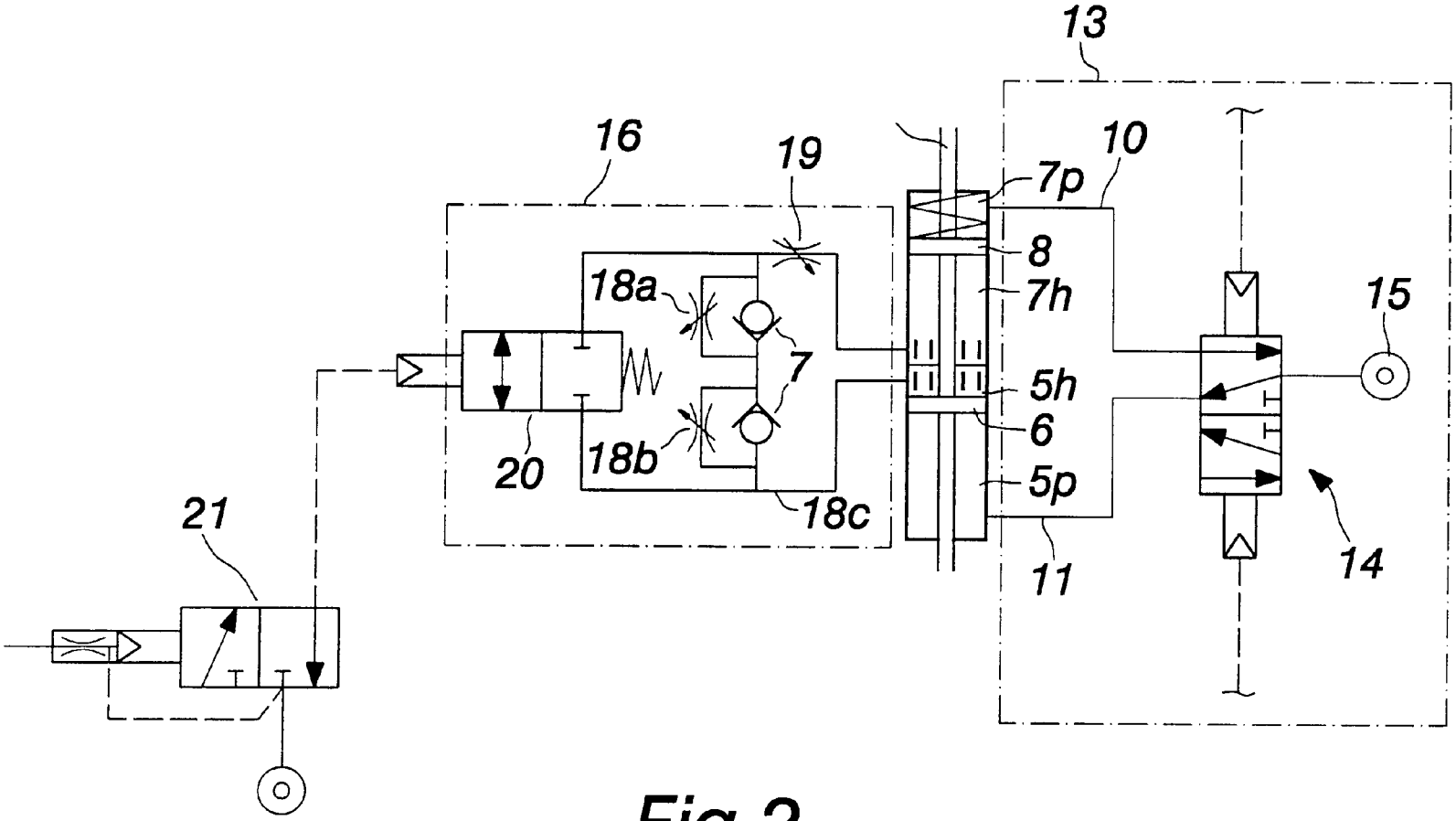
Figure 3A:
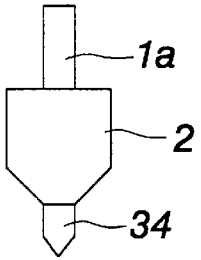
Figure 3B:
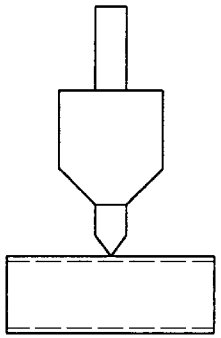
Figure 3C:
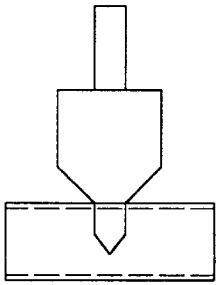
Figure 4A:
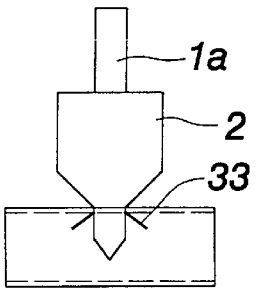
Figure 4B:
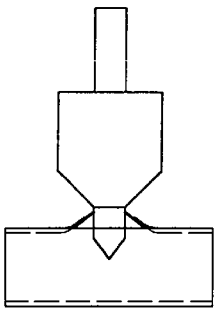
Figure 4C:
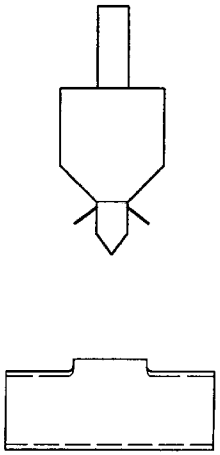

One exemplary embodiment of the invention will now be described in more detail with reference to the accompanying drawings, in which FIG. 1 shows a mechanism of the invention in a partial elevation;

FIG. 2 shows the most essential elements for the pneumatic side and hydraulic side of a piston-cylinder assembly effecting the axial motions for a mechanism of the invention; and FIGS. 3A–3C depict schematically the actions of a tool head 2 during a hole-making operation; and FIGS. 4A–4C depict schematically the axial movements of a tool head 2 during a collar-forming operation.

The bottom end of a drive shaft 1 to be rotated by an actuator 3 is fitted with a tool head 2, comprising conventionally a drill bit 34 and collar-forming pegs 33, which engage in slots present in the conical surface of an adjusting means 32 in such a way that, by rotating the adjusting means 32 relative to the rod of the drill 34, the collar-forming pegs 33 can be extended from the drill bit or retracted into the drill bit, depending on the rotational direction of the adjusting means 32. The arrangement can be conventionally such that a spiral spring keeps the adjusting cone 32 in a position with the pegs 33 retracted but, by decelerating the rotation of the adjusting cone 32 by means of a brake 31 operated by a pneumatic cylinder 30, the pegs 33 can be extended for the duration of braking. The braking force only needs to overcome the springback factor of a spiral spring (not shown).

The tool head 2 and the drive shaft 1 are maneuvered back and forth in axial direction, in practice up and down, by means of a piston-cylinder assembly 5–9, comprising two cylinders 5, 7, the lower cylinder 5 of which constitutes at the same time a housing 4, which is braced to be immobile. Each cylinder carries a piston 6, 8, on one side of which is provided a hydraulic fluid compartment 5*h* and 7*h*, respectively, and on the other side there is a cylinder compartment 5*p*, 7*p* for a pneumatic gas. The pistons 6, 8 and the cylinder compartments 5*p* and 7*p*, present on the opposite sides thereof, constitute a double-acting pneumatic piston-cylinder assembly, wherein the traveling direction of the pistons 6, 8, and that of a piston rod 9 secured thereto, is adapted to be reversed by means of a reversing valve 14 (FIG. 2). Depending on the position of the valve 14 visible in FIG. 2, the pistons 6, 8 and the piston rod 9 travel up or down as a result of pressure coming from a source of compressed air 15. Control over operating speeds and operating ranges is effected as follows.

For a hydraulic limitation to the speeds of actual working actions, the hydraulic fluid compartments 5*h*, 7*h* are in a flow communication with each other by way of a flow channel 18*c* (FIG. 2) provided with oppositely facing directional control valves 17 and, alongside the same, individually adjustable throttle valves 18*a*, 18*b*. Manual adjusting knobs 16 for the throttle valves are visible in FIG. 1 along with a hydraulic valve block 16. Thus, the working actions or strokes effected up and down can be given speeds different from each other and controllable in a stepless fashion.

In addition to slow working actions, it is necessary to have high-speed actions for delivering the tool head 2 from a top position (FIG. 3A) to an initial drilling position (FIG. 3B) and, after completing a collar, back to the top position (FIG. 4C). In order to accomplish these high-speed or rapid actions, the throttle valves 8*a*, 8*b* are adapted to be by-passed by a hydraulic on/off valve 20, in the on-position of which the tool head is drivable with said rapid actions. The hydraulic valve 20 receives its control from a pneumatic impulse valve 21, the impulse output threshold of which determines the initial position of a drilling operation and the terminal position of a collar-forming operation. Therefore, a flange 24 movable along with the tool head 2 is fitted with an impulse output threshold barrier 23, 26, whose position is vertically adjustable by means of a screw spindle 25. As the pneumatic impulse valve 21 has its roller 22 running along the outer threshold barrier surface 23, the hydraulic valve 20 will be in its on-position, allowing an unimpeded circulation of hydraulic fluid between the cylinder compartments 5*h*, 7*h*, whereby the pneumatic cylinders 5*p*, 7*p* are capable of driving the piston rod 9 up or down with a high-speed action. The condition of FIG. 1 corresponds to the initial condition shown in FIG. 3A, wherein the roller 22 is in its extreme bottom position with respect to the impulse output threshold barrier 23, 25, 26 (which, in turn, is set in its top position). As the downward rapid motion reaches the initial drilling position (FIG. 3B), the roller 22 will be released from the surface 23 at the conical end 26, the valve 21 releasing the valve 20 to its off-position (the condition of FIG. 2). This terminates a rapid action and the action or motion continues at a drilling speed set by the throttle valve 18*a*. The speed of a rapid action can be controlled by a throttle valve 19.

As the drilling is completed (FIG. 3C), a bottom barrier 27 collides with a flange 28 of the housing 4 and in so doing closes a port 29 associated with the pneumatic circuit. This closure delivers a pneumatic compressed-air pulse to a pneumatic block 13, as a result of which the reversing valve 14 reverses its direction for the commencement of a collar-forming operation (FIGS. 4A and 4B). The bottom barrier 27 sets also mechanically the bottom limit for a drilling operation exactly at a certain point, which eliminates inaccuracy of the pneumatically effected operations. The bottom barrier 27 has also its distance from the flange 28 adjustable by means of a screw tap, which attaches the barrier 27 to the flange 24.

A pressure impulse produced by closing the port 29 delivers the pressure also to a brake cylinder 30, which concurrently with a reversal extends the collar-forming pegs 33 while the adjusting cone 32 is rotated around a drill rod 1*a* by a friction brake 31.

As the collar-forming operation terminates, the valve 21 has its roller 22 collide again with the conical surface 26 of the threshold barrier 23 and shift the valve 21 to a position, wherein the compressed air is able to pass through the valve 21 for pushing the valve 20 to the on-position, allowing an unimpeded circulation of hydraulic fluid between the cylinder compartments 5*h*, 7*h*, whereby the tool head 2 rises up with a high-speed action (FIG. 4C).

An impulse threshold valve (not shown), setting the top position, drives the reversing valve 14 to an intermediate position and the pistons 6, 8 come to a halt. The next run is commenced either with manual control or automatically by delivering a control impulse to the reversing valve 14, which is driven to the top position (FIG. 2 shows the same in bottom position). The impulse threshold valve, setting the top position, may also have a threshold response or barrier which is adjustable in order to eliminate an unnecessary travel from the high-speed action.

Below the housing cylinder 4, 5 is a flange 24, which is movable along with the piston rod 9 and fitted with a journal box 2*a* for the tool head 2, with the bottom barrier 27, and with the impulse output threshold barrier 23, 25, 26 for the valve 21.

The movable flange 24 is fitted with guide bars 35 extending through the housing 4, the top ends of which are secured to a bearing flange 36 the same as the piston rod 9. The actuator 3 is also secured to the bearing flange 36.

What is claimed is:

1. An automated collar-forming drill mechanism, comprising a rotatable drive shaft (1), a tool head (2) mounted on the end of the drive shaft, an actuator (3) for rotating the drive shaft, transfer means (5–9) for carrying the drive shaft (1) and the tool head (2) back and forth in a first axial direction and a second axial direction opposite to the first axial direction, said tool head (2) comprising a drill (34) for drilling a hole in a wall of a workpiece as the tool head (2) is carried in the first axial direction during a drilling operation, and collar-forming pegs (3) that extend below a rim of the hole in the workpiece to extract material encircling the hole in the wall of the workpiece for a collar as the tool head (2) is carried in the second axial direction during a collar-forming operation, wherein the transfer means includes a power unit for axial movement, said power unit comprising a double-acting piston-cylinder assembly, said piston-cylinder assembly being operable reversably in a first forward direction and a reverse second direction, said second reverse direction being actuable by means of a reversing valve (14), and a speed of motion of said piston-cylinder assembly in the first and second directions is hydraulically limited, and wherein said piston-cylinder assembly comprises two cylinders, each one of said two cylinders including a piston having a first side provided with a pneumatic gas, and a second side having hydraulic fluid compartments with a hydraulic fluid therein, said hydraulic fluid compartments being in flow communication with each other.

2. A mechanism as set forth in claim 1, wherein the reversing valve (14) receives its control from a mechanical bottom barrier (27) for drilling operation.

3. A mechanism as set forth in claim 2, wherein the bottom barrier (27) sets mechanically a bottom limit for drilling operation and concurrently closes a port (29) associated with a pneumatic circuit, the closure of which produces a pneumatic pressure impulse, which results in a reversal of the reversing valve (14) for the commencement of a collar-forming operation.

4. A mechanism as set forth in claim 1, further comprising throttle valves (18*a*, 18*b*) for controlling flow communication with said hydraulic fluid compartments, said throttle valves being by-passable by a hydraulic on-off valve (20), in the on-position of which the tool head (2) is drivable, with a high-speed action from a top position to a drilling operation commencing position and from a collar-forming operation terminal position to the top position.

5. A mechanism as set forth in claim 4, wherein the hydraulic valve (20) receives its control from a pneumatic impulse valve (21), having an impulse output threshold (26) which is adjustable and determines a commencing position for drilling operation and a terminal position for collar-forming operation.

6. A mechanism as set forth in claim 5, wherein the impulse valve (21) has an adjustable impulse output threshold barrier (23,25,26) secured to a movable flange (24).

7. A mechanism as set forth in claim 1, wherein the piston-cylinder assembly (5–9) comprises a piston rod (9) in the form of a tube, the drive shaft (1) extending therethrough, said drive shaft (1) being rotatable relative to the piston rod (9) but movable along with the piston rod (9) in axial direction.

8. A mechanism as set forth in claim 1 wherein the piston-cylinder assembly (5–9) has one (5) of its cylinders included in a housing (4) of the mechanism, which is propped to be immobile and below which is a flange (24) movable along with the piston rod (9) and fitted with a journal box (2*a*) for the tool head (2) and with an adjustable bottom barrier (27), whose barrier element comprises a flange (28) protruding from the housing (4).

9. A mechanism as set forth in claim 8 wherein the movable flange (24) is fitted with guide bars (35) extending through the housing (4) and having the top ends thereof secured to a bearing flange (36) the same as the piston rod (9), the actuator (3) being secured to the bearing flange (36).

* * * * *